US006492313B1

(12) United States Patent
Connors et al.

(10) Patent No.: US 6,492,313 B1
(45) Date of Patent: Dec. 10, 2002

(54) ANTIBACTERIAL LIGHT DUTY LIQUID DETERGENT CONTAINING ZINC SALT

(75) Inventors: Thomas Connors, Piscataway, NJ (US); Robert D'Ambrogio, Bound Brook, NJ (US); Bruce Nascimbeni, Millstone, NJ (US)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 10/192,935

(22) Filed: Jul. 11, 2002

(51) Int. Cl.[7] ..... C11D 17/00

(52) U.S. Cl. ..... 510/221; 510/235; 510/425; 510/424; 510/433; 510/470; 510/490; 510/499; 510/508

(58) Field of Search ..... 510/221, 235, 510/424, 425, 433, 470, 490, 499, 508

(56) References Cited

U.S. PATENT DOCUMENTS 3,619,115 A * 11/1971 Diehl et al. ..... 8/137
3,970,596 A * 7/1976 Klisch et al. ..... 252/546
4,492,646 A * 1/1985 Welch ..... 252/528
5,230,823 A * 7/1993 Wise et al. ..... 252/174.21
6,313,084 B1 * 11/2001 D'Ambrogio et al. ..... 510/425

* cited by examiner

*Primary Examiner*—Necholus Ogden
(74) *Attorney, Agent, or Firm*—Richard E. Nanfeldt

(57) ABSTRACT

A light duty, liquid comprising: a paraffin sulfonate, an alpha olefin sulfonate, an amine oxide, lauryol ethylenediaminetriacetate, a zinc inorganic salt and water.

10 Claims, No Drawings

ANTIBACTERIAL LIGHT DUTY LIQUID DETERGENT CONTAINING ZINC SALT

FIELD OF THE INVENTION

The present invention relates to novel antibacterial light duty liquid cleaning compositions with high foaming and good grease cutting properties.

BACKGROUND OF THE INVENTION

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming antibacterial light duty liquid cleaning composition can be formulated with a paraffin sulfonate, an alpha olefin sulfonate, an amine oxide, lauryol ethylene diaminetriacetate, a magnesium inorganic salt, a zinc inorganic salt, an alkali metal inorganic salt, a proton donating agent, and water.

Accordingly, one object of this invention is to provide novel, high foaming, light duty liquid detergent compositions containing an alpha olefin sulfonate surfactant and lauryol ethoylene diamine triacetate which has both good grease cutting and excellent disinfecting properties on hard surfaces.

To achieve the foregoing and other objects and in accordance with the purpose of the present invention, as embodied and broadly described herein the novel, high foaming, light duty liquid detergent of this invention comprises an alpha olefin sulfonate, a paraffin sulfonate, an amine oxide, lauryol ethylene diamine triacetate, a magnesium inorganic salt, a zinc inorganic salt, an alkali metal inorganic salt, a proton donating agent, and water, wherein the composition does not contain an alkali metal salt of ethylene diamine tetraacetic acid or hydroxy ethylene diamine tetra acetic acid, a glycol ether solvent, a mono- or di-saccharides a polyoxyalkylene glycol fatty acid, a builder, a polymeric thickener, a clay, a fatty acid alkanolamide, abrasive, silicas, tricloscan, alkaline earth metal carbonates, alkyl glycine surfactant or cyclic imidinium surfactant.

DETAILED DESCRIPTION OF THE INVENTION

The present invention relates to an antibacterial light duty liquid cleaning composition which comprises approximately by weight:

(a) 10% to 30% of an alpha olefin sulfonate surfactant;
(b) 4% to 16% of a paraffin sulfonate surfactant;
(c) 7% to 15% of an amine oxide;
(d) 0.5% to 10% more preferably 0.75% to 8% of lauryol ethylene diamine triacetate;
(e) 0.25% to 10% of a solubilizing agent;
(f) 0.25% to 5% of a magnesium inorganic salt;
(g) 0.25% to 5% of an alkali metal inorganic salt;
(h) 0.01 % to 2% of a proton donating agent;
(i) 0.25% to 2% of a zinc inorganic salt; and
(j) the balance being water wherein the composition does not contain a glycol ether solvent, an ethoxylated nonionic surfactant, a polyoxyalkylene glycol fatty acid, a mono- or di-saccharides, a builder, a polymeric thickener, a clay, a sodium salt of ethylene diamine tetraacetic acid or hydroxyethylene diamine tetra acetic acid abrasive, silicas, triclosan, alkaline earth metal carbonates, alkyl glycine surfactant or cyclic imidinium surfactant.

The $C_{10}$–C20 paraffin sulfonates used at a concentration of 4 wt. % to 16 wt. %, more preferably 6 wt. % to 14 wt.

% in the instant compositions may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744 and 3,372,188 and also in German Patent. 735,096. Such compounds may be made to specifications and desirably the content of paraffin sulfonates outside the $C_{14-17}$ range will be minor and will be minimized, as will be any contents of di- or poly-sulfonates.

The present invention also contains 10 wt. % to 30 wt. %, more preferably 15 wt. % to 25 wt. % of an alpha olefin sulfonates, including long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The instant compositions can optionally contain about 0 wt. % to about 12 wt. %, more preferably 1 wt. % to 10 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1 -position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

Amine oxide semi-polar nonionic surfactants used in the instant compositions comprise at a concentration of 7 wt. % to 15 wt. %, more preferably 9 wt. % to 13 wt. % compounds and mixtures of compounds having the formula

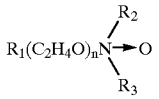

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

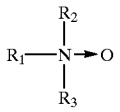

wherein $R_1$ is a $C_{12-16}$ alkyl, or cocoamidopropyl group and $R_2$ and $R_3$ are methyl or ethyl. The above ethylene oxide condensates, amides, and amine oxides are more fully described in U.S. Pat. No. 4,316,824 which is hereby incorporated herein by reference. Preferred amine oxides are lauryol amine oxide and cocoamido propyl amine oxide. The concentration of the amine oxide in the instant compositions is 3 to 12 wt. %, more preferably 4 to 10 wt. %.

The instant compositions can contain a solubilizing agent at a concentration of 0.25 to 10 wt. %, more preferably 0.5 wt. % to 8 wt. %. The solubilzing agent is selected from the group consisting of $C_1$–$C_4$ alkanols such as ethanols, alkylene glycols such as hexylene glycol, alkali metal halides such as sodium chloride and sodium salts of $C_1$–$C_3$ alkyl substituted benzene sulfonates such as cumene sulfonate or xylene sulfonate and mixtures thereof. The composition can also contain 0.1 wt. % to 4 wt. % of urea.

The proton donating agent is a hydroxy containing organic acid such as hydroxy benzoic acid, citric acid or lactic acid, glycolic acid, salicylic acid or an inorganic acid.

The zinc inorganic can be zinc sulfate or zinc halide such as zinc chloride or zinc bromide, wherein zinc chloride is preferred. The alkali metal inorganic salt is an alkali metal halide, wherein sodium chloride is preferred. The magnesium inorganic salt is either magnesium chloride or magnesium sulfate heptahydrate.

The water is present at a concentration of 50 wt. % to 90 wt. %.

In addition to the previously mentioned essential and optional constituents of the light duty liquid detergent, one may also employ normal and conventional adjuvants, provided they do not adversely affect the properties of the detergent. Thus there may be used a cationic antibacterial agent, coloring agents and perfumes; polyethylene glycol, ultraviolet light absorbers such as the Uvinuls, which are products of GAF Corporation; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin or Quaternium 15 (Dowcil75) can be included in the formula as a preservative at a concentration of 0.1 to 4.0 wt. %.

The present light duty liquid detergents such as dishwashing liquids are readily made by simple mixing methods from readily available components which, on storage, do not adversely affect the entire composition. Solubilizing agent such as ethanol, hexylene glycol, sodium chloride and/or sodium xylene or sodium xylene sulfonate are used to assist in solubilizing the surfactants. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition and the light duty liquid composition itself remain stable on storage for lengthy periods of time, without color changes or settling out of any insoluble materials. The pH of the composition is about 3 to 8.0. The pH of the composition can be adjusted by the addition of Na2O (caustic soda) to the composition.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

Example 1

The following formulas were prepared at room temperature by simple liquid mixing procedures as previously described

| | A | B | C | D | E |
|---|---|---|---|---|---|
| Sodium alpha olefin sulfonate | 21.00 | 21.00 | 21.00 | 21.00 | 21.00 |
| C12–C14 amidopropylamine oxide | 11.00 | 11.00 | 11.00 | 11.00 | 11.00 |
| Sodium paraffin sulfonate | 9.00 | 9.00 | 9.00 | 9.00 | 9.00 |
| Ethanol | 6.40 | 6.40 | 6.40 | 6.40 | 6.40 |
| MgCl2*6H2O | 2.00 | 2.00 | 2.00 | 2.00 | 2.00 |
| NaCl | 2.00 | 2.00 | 2.00 | 2.00 | 2.00 |
| Fragrance | 0.45 | 0.45 | 0.45 | 0.45 | 0.45 |
| Citric acid | 0.10 | 0.10 | 0.10 | 0.10 | 0.10 |
| Sodium LED3A | | 2.40 | 2.40 | | |
| HEDTA | | | | | 2.40 |

-continued

| | A | B | C | D | E |
|---|---|---|---|---|---|
| Zinc chloride | | 1.00 | | 1.00 | 1.00 |
| Deionized water | Bal. | Bal. | Bal. | Bal. | Bal. |
| Efficacy measurements | | | | | |
| SIKT | Log Reduction | Log Reduction | Log Reduction | Log Reduction | Log Reduction |
| *Staphylococcus aureaus* | 2.3 | 3.3 | | | |
| *Staphylococcus epidermidis* | 0.6 | 1.6 | | | |
| *Escherichia coli* | 0.1 | 0.8 | | | |
| D-value | AUC 66.9 | AUC 165.5 | AUC 125.7 | AUC 161.6 | AUC 159.6 |
| Appearance | Translucent | Translucent | Translucent | Cloudy | Cloudy |
| Stability @ RT for 6 months | Acceptable | Acceptable | Acceptable | Precipitate | Precipitate |

What is claimed is:

1. A light duty liquid composition comprising approximately by weight:

(a) 10% to 30% of an alpha olefin sulfonate;

(b) 4% to 16% of a $C_{10}$–$C_{20}$ paraffin sulfonate;

(c) 7% to 15% of an amine oxide;

(d) 0.5% to 10% of a lauryol ethylene diamine triacetate;

(e) 0.25% to 2% of a zinc inorganic salt; and (f) the balance being water wherein the composition does not contain a glycol ether solvent, an ethoxylated nonionic surfactant, a polyalkylene glycol fatty acid, a mono- or di-saccharides, a builder, a polymeric thickener, a clay, a sodium salt of ethylene diamine tetra acetic acid or hydroxyethylene diamine tetra acetic acid, abrasives, silicas, triclosan, alkaline earth metal carbonates, alkyl glycine surfactant or cyclic imidinium surfactant.

2. A light duty liquid composition according to claim 1 which includes, in addition, 0.25% to 10% by weight of a solubilizing agent which is selected from the group of a $C_1$–$C_4$ alkanol and/or a water soluble salts of $C_1$–$C_3$ substituted benzene sulfonate hydrotropes and mixtures thereof.

3. A light duty liquid composition according to claim 1 further including a preservative.

4. A light duty liquid composition according to claim 1 further including a color stabilizer.

5. A light duty liquid composition according to claim 1, wherein said composition has a pH of about 3 to about 8.0.

6. A light duty liquid composition according to claim 1 further including a proton donating agent.

7. A light duty liquid composition according to claim 6, wherein said proton donating agent is selected from the group consisting of hydroxy containing organic acids and inorganic acids and mixtures thereof.

8. A light duty liquid composition according to claim 6, wherein said proton donating agent is citric acid.

9. A light duty liquid composition according to claim 7, further including a magnesium inorganic salt.

10. A light duty liquid composition according to claim 9, further including an alkali metal inorganic salt.

* * * * *